US005442602A

United States Patent [19]

Hirai et al.

[11] Patent Number: 5,442,602

[45] Date of Patent: Aug. 15, 1995

[54] WRISTWATCH CASE WITH SHOCK ABSORBING MEMBERS ON THE REAR SIDE THEREOF

[75] Inventors: Masaaki Hirai; Mitsuo Matsunaga; Yoshiya Kato, all of Tokyo, Japan

[73] Assignee: Casio Computer Co., Ltd., Tokyo, Japan

[21] Appl. No.: 291,098

[22] Filed: Aug. 16, 1994

[30] Foreign Application Priority Data

Aug. 25, 1993 [JP] Japan ..... 5-232321
Jan. 31, 1994 [JP] Japan ..... 6-025860

[51] Int. Cl.[6] ..... G04B 37/00

[52] U.S. Cl. ..... 368/286; 368/287; 368/309

[58] Field of Search ..... 368/276, 280, 283, 286, 368/287, 255, 309; 224/169, 170, 173, 178

[56] References Cited

U.S. PATENT DOCUMENTS 1,378,747 5/1921 White .
2,617,249 11/1952 Devay .
2,745,580 5/1956 Ward .
3,149,452 9/1964 Smith .
3,584,455 6/1971 Sion .
4,459,027 7/1984 Toyoda ..... 368/255
4,692,033 9/1987 Mock et al. ..... 368/280
4,835,750 5/1989 Quincey ..... 368/286
4,837,756 6/1989 Hartman et al. ..... 368/286

FOREIGN PATENT DOCUMENTS 482082 2/1917 France .
193967 2/1938 Germany .
2230877 10/1990 United Kingdom .

*Primary Examiner*—Vit W. Miska
*Attorney, Agent, or Firm*—Frishauf, Holtz, Goodman, Langer & Chick

[57] ABSTRACT

Shock absorbing members are attached to an outer rim of a back surface of a wristwatch case body at 6- and 12-o'clock portions thereof, and they extend outward and curve downward. Each of the shock absorbing members has rising portions extending from its both side ends and which are freely swingably attached to the wristwatch case body to a circumferential surface of the wristwatch case body. In addition, a part of a front surface and the circumferential surface of the wristwatch case body are covered by a first cover member made of soft synthetic resin, and the first cover is partly covered by a metal-made second cover member. When shock is applied to the front and circumferential surfaces of the wristwatch case body, the shock is reduced or absorbed by the rising portions of the shock absorbing members. When shock is applied to the back surface of the case body, the shock is reduced or absorbed by the shock absorbing member.

27 Claims, 12 Drawing Sheets

WRISTWATCH CASE WITH SHOCK ABSORBING MEMBERS ON THE REAR SIDE THEREOF

BACKGROUND OF THE INVENTION

1. Field of the Invention

The present invention relates to a wristwatch case having a shock resistant structure.

2. Description of the Related Art

As a shock resistance structure, it is well known that a cover made of soft synthetic resin is attached to the wristwatch case. This cover decorates the wristwatch case and also serves to resist any shock applied to front and circumferential surfaces of the wristwatch case.

No shock resistance structure is provided on a back surface of the wristwatch case because the back surface contacts directly a wrist of an user.

In some of wristwatches, a pair of wrist bands are attached to the wristwatch case at 6- and 12-o'clock positions thereof and are curved backward at all times to fit an outline of the wrist.

In the case of wristwatches having these wrist bands, the wrist bands serve as a cushion to absorb any shock applied to the back surface of the wristwatch case when the wristwatch is dropped on the floor, for example. However, the wrist bands themselves must be curved backward and unswingable at any time. Therefore, an attaching structure of the wrist bands to the wristwatch case, material of the wrist bands, and design thereof are limited.

SUMMARY OF THE INVENTION

An object of the present invention is therefore to provide a wristwatch case having a shock resistant structure to resist any shock applied to a back surface of the wristwatch case but having no limitation in an attaching structure of wrist bands to the wristwatch case and also in material of the wrist bands.

In order to achieve the object, a wristwatch case of this invention comprises a wristwatch case body having wrist band attaching portions, a back cover attached to a back surface of the case body, and a shock absorbing member attached to the back surface of the back cover.

According to the above-described wristwatch case, shock resistance relative to shock applied to the back surface of the wristwatch case can be increased to a greater extent.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

First Embodiment

Figure 1:
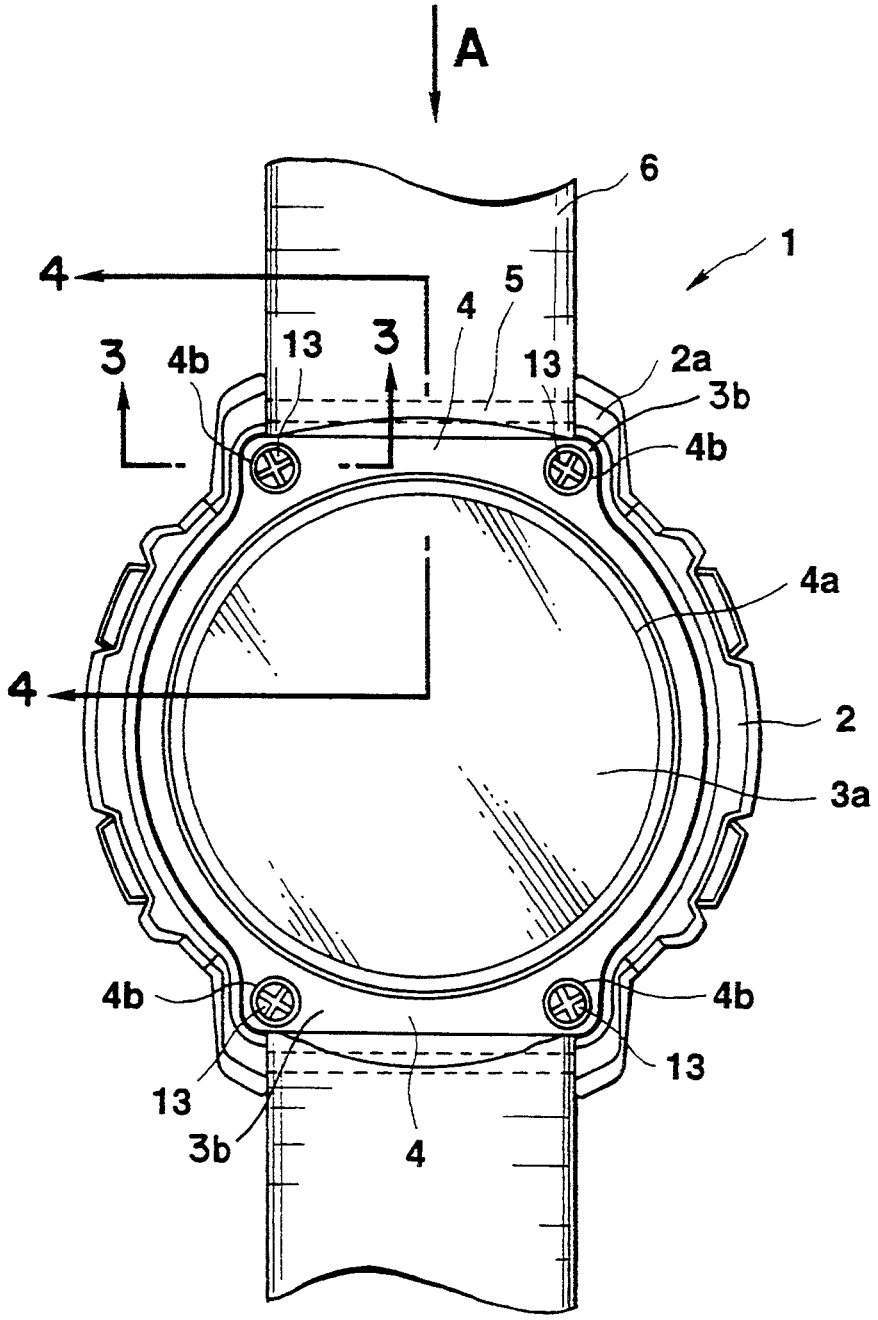
FIG. 1 is a back view showing a back surface of a wristwatch case according to a first embodiment of the present invention.
Figure 2:
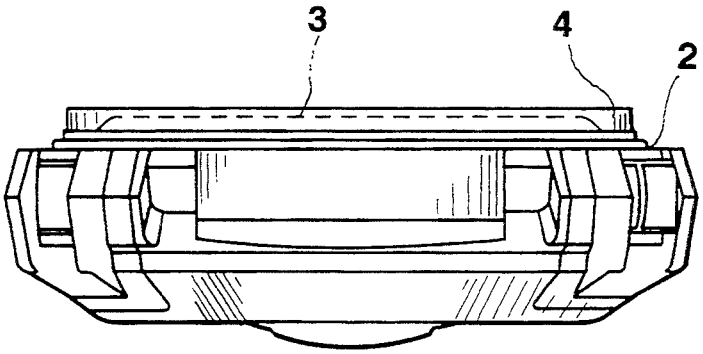
FIG. 2 is a side view showing the wristwatch case of FIG. 1 viewed in a direction A in FIG. 1.
Figure 3:
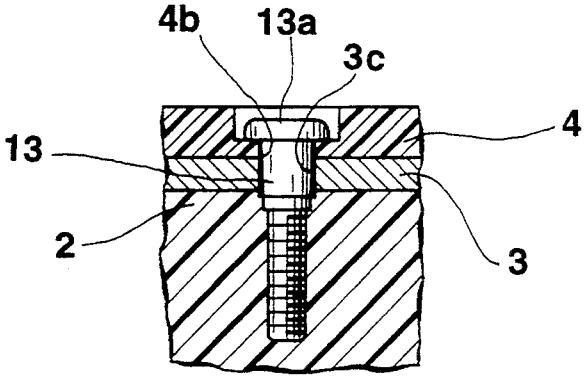
FIG. 3 is an enlarged sectional view taken along a line 3—3 in FIG. 1.

FIGS. 1 through 4 show a wristwatch using a wristwatch case having a shock resistance structure according to a first embodiment of the present invention. A back cover 3 is attached to a back surface of a wristwatch case body 2. A shock absorbing member 4 is attached to a back surface of the back cover 3. The shock absorbing member 4 extends along an outer rim of the back cover 3 to have substantially the same shape as that of the outer rim of the back cover 3, and projects backward from the back surface of the back cover 3. The shock absorbing member 4 is shaped like a ring and is made of rubber such as polyurethane or soft synthetic resin. The shock absorbing member 4 is detachably attached to the back cover 3 at four positions by fixing screws 13. The fixing screws 13 are screwed into the wristwatch case body 2 through the back cover 3, while the shock absorbing member 4 is pressed on the back cover 3 by the heads 13*a*, of the screws 13 as shown in FIG. 3.

Figure 4:
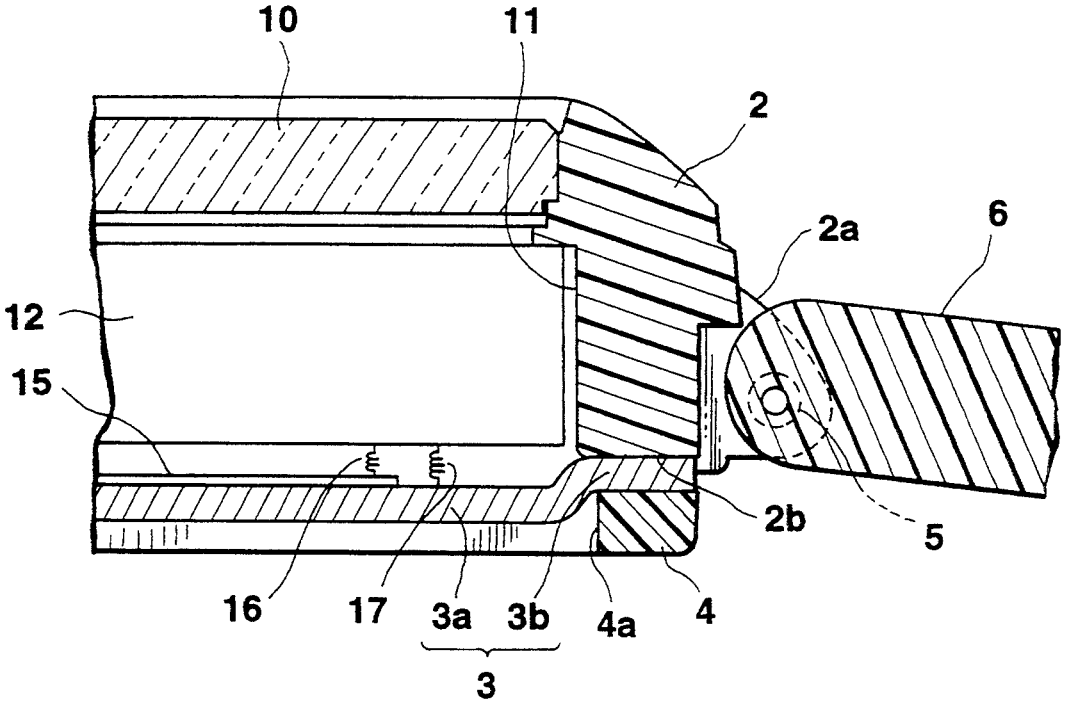
FIG. 4 is an enlarged sectional view of a main part of the wristwatch, taken along line 4—4 in FIG. 1.

As shown in FIG. 4, the wristwatch case body 2 has wrist band attaching portions 2*a* and 2*a* at 6- and 12-o'clock positions, to which wrist bands 6 are freely swingably attached by spring rods 5 and 5. A cover glass 10 is arranged at a front surface of the wristwatch case body 2, and a movement space 11 is formed so that it opens in the back surface of the wristwatch case body 2. A time module 12 is housed in the movement space 11. The wristwatch case body 2 is provided with back cover attaching portions 2*b* and 2*b* at 6- and 12-o'clock positions on the outer rim of the back surface of the wristwatch case body 2.

The back cover 3 is integrally formed by a cover main portion 3*a* shaped like a circle and closing the backside surface opening of the movement space 11 in the wristwatch case body 2, and flange portions 3*b* and 3*b* which are is contacted with the back cover attaching portions 2*b* and 2*b* of the case body 2. Two through holes 3*c* (FIG. 3) into which the fixing screws 13 are inserted are formed in each of the flange portions 3*b* and 3*b*. The back cover 3 is made of electrically conductive metal. A piezoelectric element 15 is bonded to an inner surface of the cover main portion 3*a*.

An opening portion 4*a* of the shock absorbing member 4 corresponds to the cover main portion 3*a* of the back cover 3 which is vibrated by the piezoelectric element 15 as described later. The shock absorbing member 4 is positioned to be contacted with the back surface of each of the flange portions 3*b* and 3*b* of the back cover 3. Through holes 4*b* are formed in the shock absorbing member 4 to correspond in positions to the through holes 3*c* in the flange portions 3*b* and 3*b* of the back cover 3, and each through hole 4*b* has the same diameter as that of each of the through holes 3*c* in the flange portions 3*b* and 3*b* of the back cover 3. By inserting the fixing screws 13 into the through holes 4*b* of the shock absorbing member 4 and the through holes 3*c* of the flange portions 3*b* and 3*b* of the cover member 3 and screwing the fixing screws 13 into the back surface of the wristwatch case body 2, the shock absorbing member 4 and the back cover 3 are detachably fixed to the back surface of the back cover 3. This shock absorbing member 4 is made of rubber material such as polyurethane or soft synthetic resin.

The time module 12 is prepared by mounting a liquid crystal display device, a circuit plate to which an LSI is attached, a battery, etc. in a housing made of synthetic resin. In the movement space 11, the liquid crystal display device is positioned near to an inner surface of the cover glass 10 which is arranged at the center of the front surface of the wristwatch case body 2.

Two springs 16 and 17 are projected from a back surface of the time module 12. A back end of one spring 16 contacts an electrode of the piezoelectric element 15 and a back end of the other spring 17 contacts an inner surface of the back cover 3.

In order to generate an alarm sound, a pulse-shaped voltage is applied from the LSI to the piezoelectric element 15 through the springs 16 and 17. The piezoelectric element 15 is thus vibrated to vibrate the cover main portion 3*a* of the back cover 3, and the vibrated cover main portion 3*a* of the back cover 3 generates the alarm sound.

According to the wristwatch case of the first embodiment of the present invention as described above, the shock absorbing member 4 is attached to the back surface of the back cover 3. Therefore, even if the wristwatch is dropped on a hard thing, a shock to be applied directly to the back cover 3 can be reduced or absorbed by the shock absorbing member 4.

Further, there is no need to make the wrist bands as a shock-resistant structure as seen in the conventional cases. This enables the wrist bands 6 to be freely swingably attached to the wristwatch case body 2. The fitting of the wristwatch to a wrist of a user can be thus improved. In addition, other materials such as nylon and metal excepting soft synthetic resins can be used for the wrist bands. More widely kinds of materials and designs than the conventional ones can be used.

Furthermore, since the opening portion 4*a* of the shock absorbing member 4 is positioned over the cover main portion 3*a* of the back cover 3, which is vibrated by the piezoelectric element 15, the cover main portion 3*a* can be more easily vibrated to generate a greater alarm sound.

Still further, since the shock absorbing member 4 and the back plate 3 are detachably fixed to the wristwatch case body 2 by common fixing screws 13, the number of parts used in the wristwatch case can be reduced and the work to fix the shock absorbing member 4 and the back plate 3 to the wristwatch case body 2 can be made easier.

Still further, since a shock applied directly to the back surface of the back cover 3 can be reduced or absorbed by the shock absorbing member 4, even if the wristwatch will be dropped on a hard thing, the cover main portion 3*a* of the back cover 3 can be prevented from striking directly against the hard thing. This can prevent the piezoelectric element 15, which is attached to the inner surface of the cover main portion 3*a*, from being attacked directly by shock. Therefore, no counterelectromotive force is generated in the piezoelectric element 15. This can prevent the LSI in the time module 12 from malfunctioning and being broken.

Figure 5:
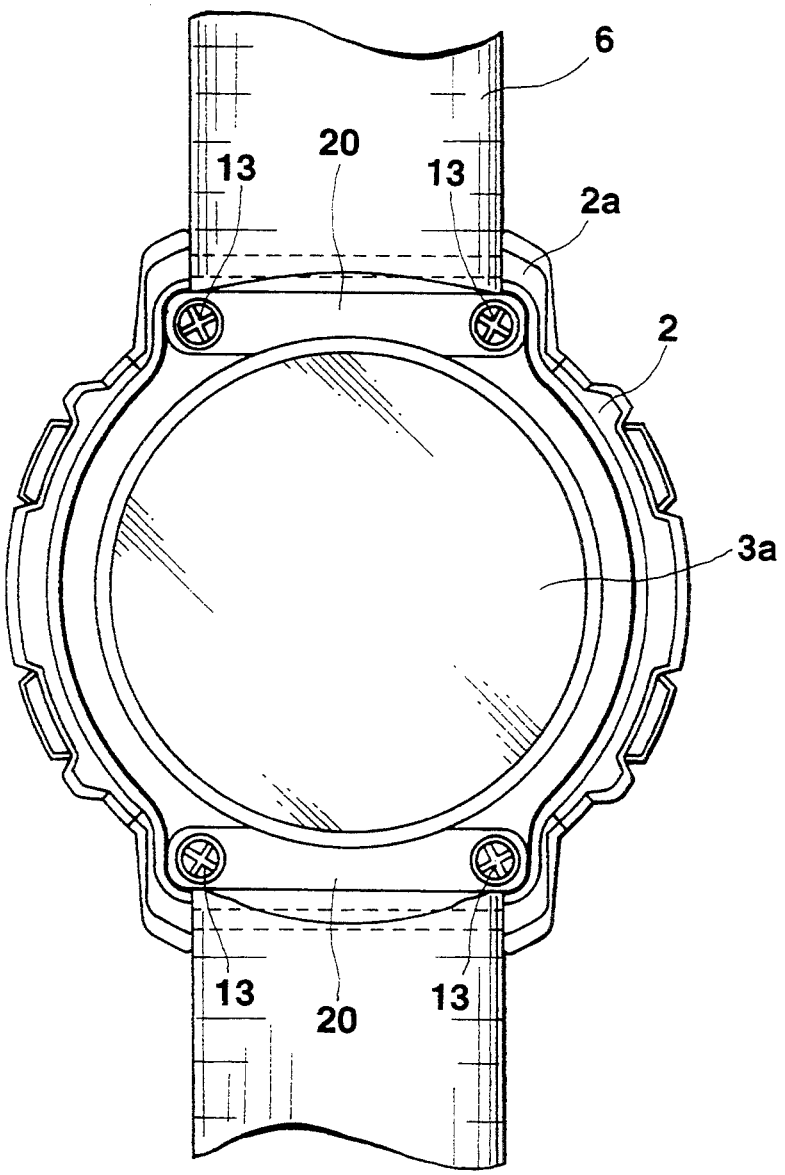
FIG. 5 is a back view showing a back surface of a wristwatch case according to a modification of the first embodiment of the present invention.

Instead of the shock absorbing member 4, other shock absorbing members 20 and 20 may be attached to the flange portions 3*b* and 3*b* formed in the outer rim of the back cover 3 by the fixing screws 13, as shown in FIG. 5.

In this modification of the first embodiment, since the shock absorbing members 20 and 20 are positioned only on the flange portions 3*b* and 3*b* which project from the back cover 3 at 6- and 12-o'clock positions thereof, the user wearing the wristwatch on his or her wrist will never feel them as being uncomfortable. In addition, the shock absorbing members 20 are so simple in shape, that manufacturing thereof can be thus made easier.

Second Embodiment

Figure 6:
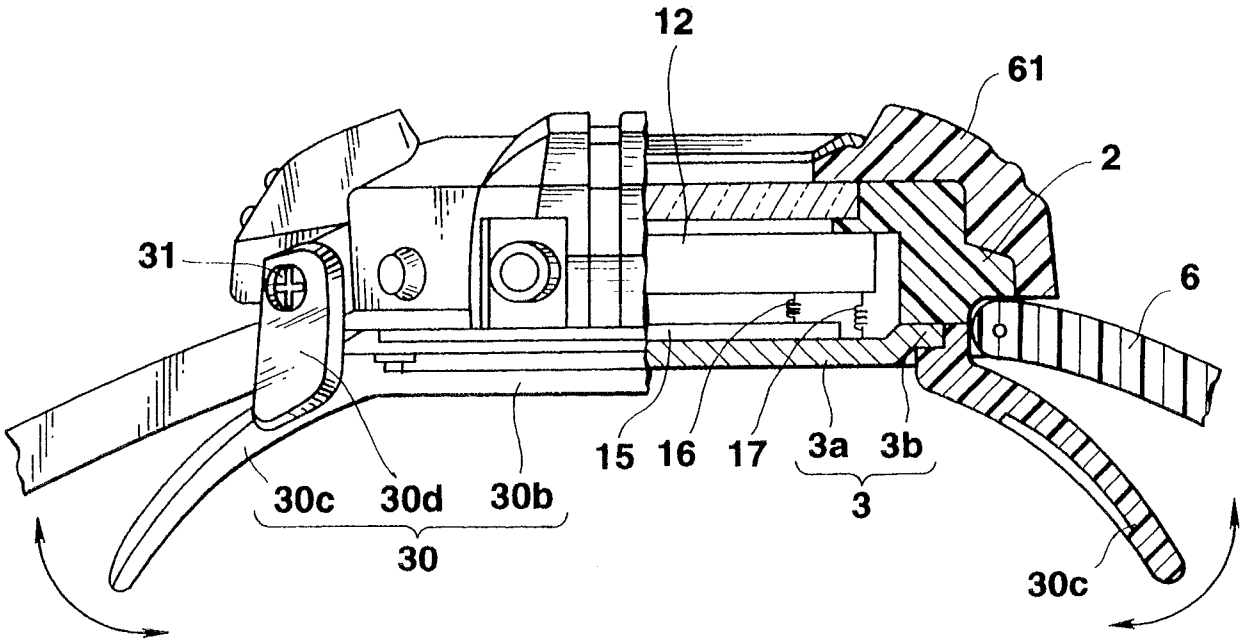
FIG. 6 is a side view showing a wristwatch case according to a second embodiment of the present invention, with a half part thereof being cut.
Figure 7:
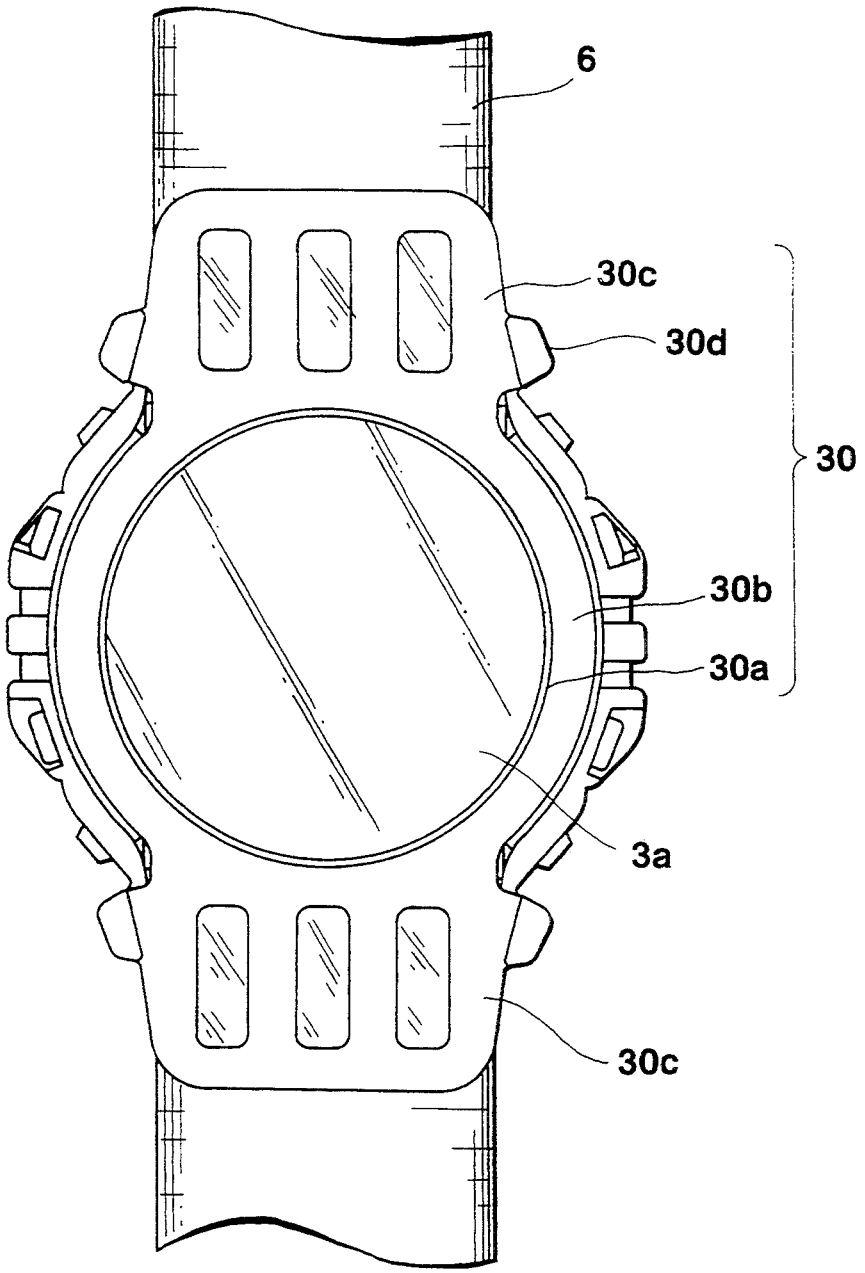
FIG. 7 is a back view showing a back surface of the wristwatch case in FIG. 6.

FIGS. 6 and 7 show a wristwatch case according to a second embodiment of the present invention. The same components as those in the first embodiment shown in FIGS. 1 through 5 will be denoted by the same reference numerals as those used in the first embodiment, and a detailed description relating to these components will be omitted.

As shown in FIGS. 6 and 7, a shock absorbing member 30 is attached to the back surface of the wristwatch case body 2. The shock absorbing member 30 is formed to have the substantially the same shape as that of the outer rim of the back cover 3, and is integrally formed by a ring-shaped base portion 30*b* having an opening portion 30*a* in a center thereof, shock absorbing portions 30*c* and 30*c* extending out from 6- and 12-o'clock positions of the base portion 30*b* and curving backward away from the back cover 3, and rising portions 30*d* extending from both side ends of each shock absorbing portion 30*c* toward a circumferential surface of the wristwatch case body 2. These rising portions 30*d* are detachably attached to the circumferential surface of the wristwatch case body 2 by four fixing screws 31. The opening portion 30*a* of the base portion 30*b* is positioned over the cover main portion 3*a* of the back cover 3 which is vibrated by the piezoelectric element 15.

In the case of the wristwatch having the above-arranged shock resistant structure, since the base portion 30*b*, projected backward from the back surface of the back cover 3, and the shock absorbing portions 30*c* and 30*c*, extending out from the base portion 30*b* and curved backward, are integrally formed with each other, and further the rising portions 30*d* extending from both side ends of each shock absorbing portion 30*c* toward the circumferential surface of the wristwatch case body 2 are integrally formed with the base portion 30*b*, shock resistance of the back cover 3 is further increased. Even if the wristwatch should be dropped on the hard thing, a shock which will be applied to the back surface of the back cover 3 can be reduced or absorbed by the shock absorbing member 30. In addition, the shock absorbing member 30 can fit more comfortably to the user's wrist. Further, since the opening portion 30*a* of the shock absorbing member 30 is positioned over the cover main portion 3*a* of the back cover 3, to the inner surface of which the piezoelectric-element is attached, the cover main portion 3*a* can be more easily vibrated to generate alarm sound more larger.

Figure 8:
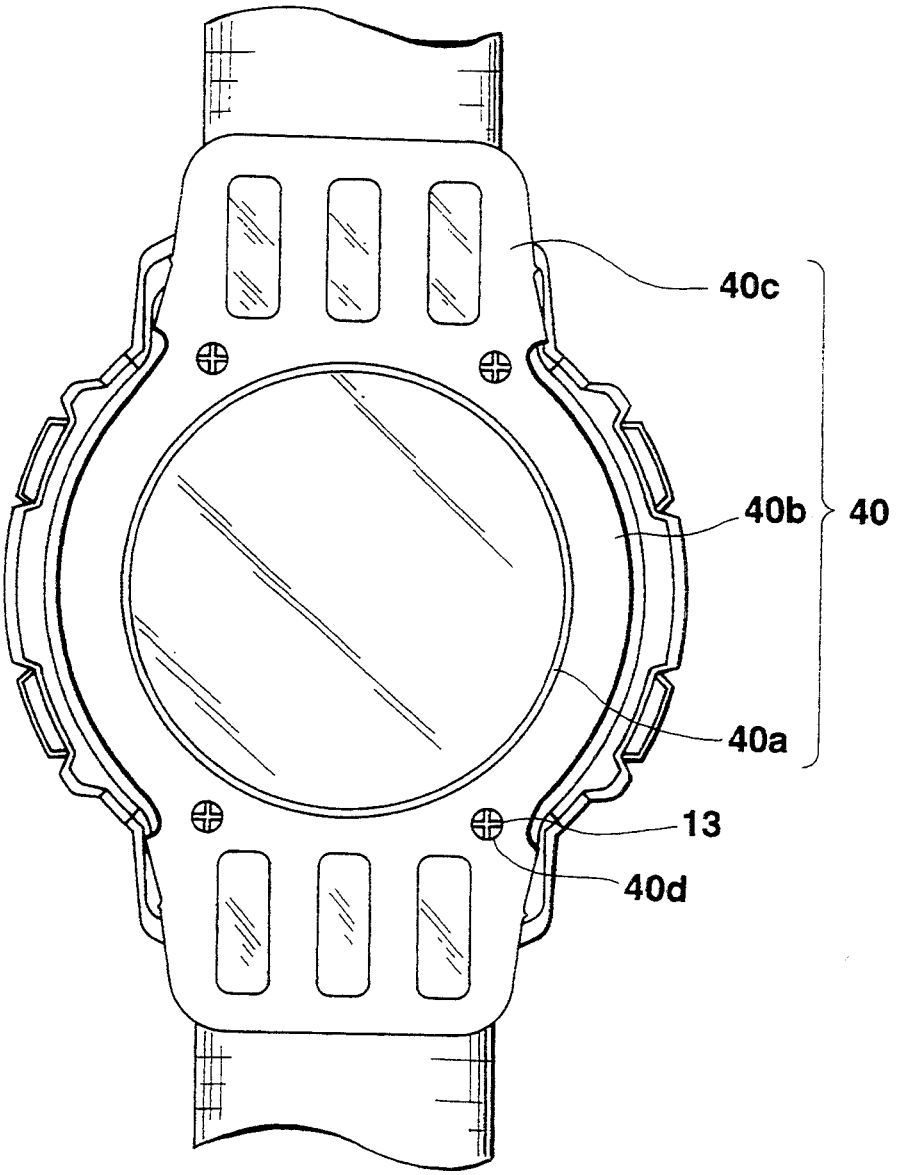
FIG. 8 is a back view showing a back surface of a wristwatch case according to a modification of the second embodiment of the present invention.

Another shock absorbing member 40 may be attached to the flange portions 3*b* of the back cover 3, as shown in FIG. 8, instead of the above-described shock absorbing member 30.

The shock absorbing member 40 is constituted by integrally forming a base portion 40*b* shaped to have substantially the same shape as that of the outer rim of the back surface of the back cover 3 and having an opening portion 40*a* in the center thereof, with shock absorbing portions 40*c* and 40*c* extending from 6- and 12-o'clock positions of the back cover 3 and curved backward.

Through holes 40*d* are formed in the base portion 40*b* at positions corresponding to the through holes 3*c* in each flange portion 3*b* of the back cover 3 to have the same diameter as that of the through hole 3*c*. The fixing screws 13 are inserted into the through holes 40*b* and 3*c* of the shock absorbing member 40 and the back cover 3 and are screwed into the wristwatch case body 2, so that the heads 13*a* of the fixing screws 13 engage with the shock absorbing member 40 and the back cover 3. As a result of this, the shock absorbing member 40 and the back cover 3 can be freely detachably attached to the case body 2.

Figure 9:
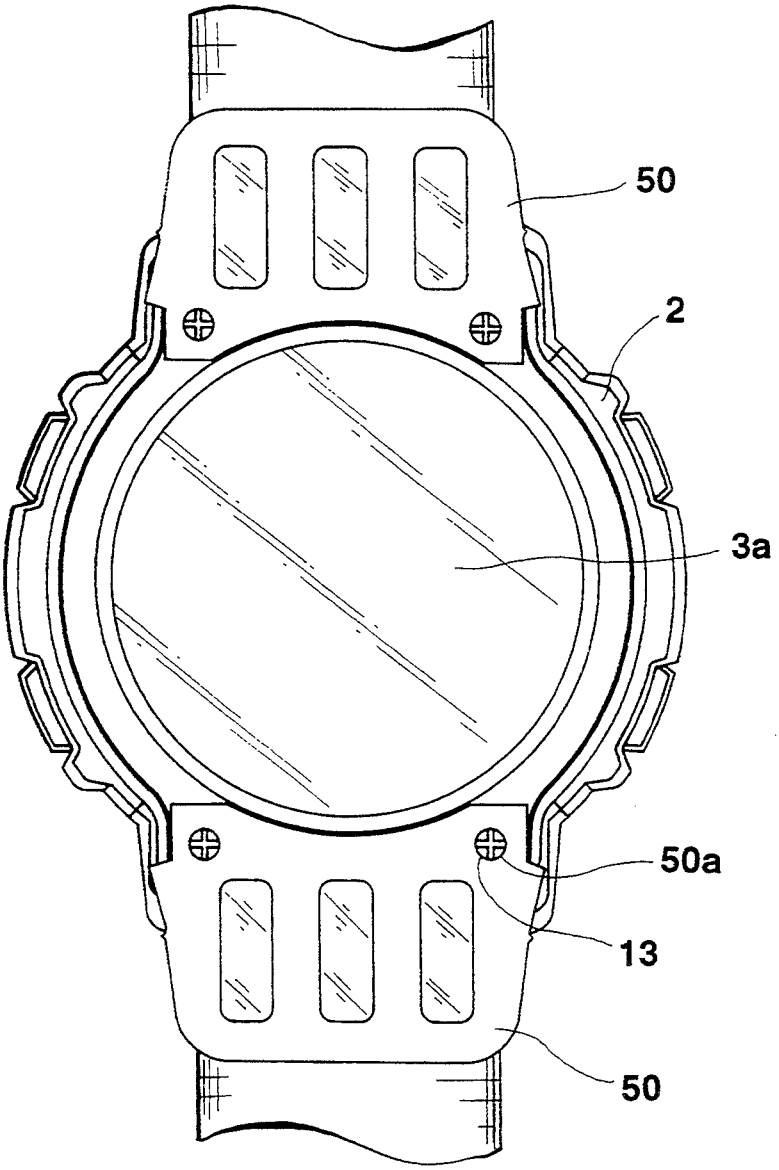
FIG. 9 is a back view showing a back surface of a wristwatch case according to another modification of the second embodiment of the present invention.

Shock absorbing members 50 and 50 may be attached to only the flange portions 3*b* and 3*b* of the back cover 3, as shown in FIG. 9, instead of the above-described shock absorbing member 30.

These shock absorbing members 50 and 50 are arranged at 6- and 12-o'clock positions of the outer rim of the back surface of the back cover 3 and are extending out in the 6- and 12-o'clock directions to curve backwardly. Through holes 50*a* are formed in each shock absorbing member 50 at positions corresponding to the through holes 3*c* in each flange portion 3*b* of the back cover 3, and each through hole 50*a* has the same diameter as that of the through holes 3*c* of the back cover 3. The fixing screws 13 are inserted into the through holes 50*a* of the shock absorbing member 50 and the through holes 3*c* of the back cover 3, and are screwed into the case body 2. The shock absorbing members 50 and the back cover 3 are pressed on the back surface of the case body 2 by the heads of the screws 13, so that the shock absorbing members 50 and the back cover member 3 can be thus detachably attached to the back surface of the case body 2.

Third Embodiment

FIGS. 10 through 13 show a wristwatch case having a shock resistant structure according to a third embodiment of the present invention. The wristwatch case includes a wristwatch case body 55 in which a time display unit (not shown) is housed, a cover member 60 attached to an outer circumferential surface of the case body 55, and shock absorbing members 70 arranged on back sides of wrist bands 71 which are attached to the case body 55 at 6- and 12-o'clock positions thereof. A cover glass 10 is fitted into a front surface of the wristwatch case body 55 with a packing 75 interposed therebetween while the back cover 3 is attached to a back surface of the body 55 with a sealing 76 interposed therebetween. The cover member 60 is constructed by first and second covers, and the cover member 60 is fixed to the outer circumferential surface of the wristwatch case body 55 by stepped pins 63.

In this embodiment, the cover member 60 is constructed by integrally forming a first cover 61 made of soft synthetic resin with a second cover 62 made of metal. The first cover 61 has an upwardly swelling portion 61*a* covering all of an outer rim of a front surface of the case body 55 and swelling upward from the front surface, with a sidewardly swelling portion 61*b* swelling sideward from a part of an outer circumferential surface of the case body 55. Since the first cover 61 is made of soft synthetic resin, it reduces or absorbs any shock applied to the front and circumferential surfaces of the wristwatch case body 55. This first cover 61 is designed to have a solid appearance.

Figure 10:
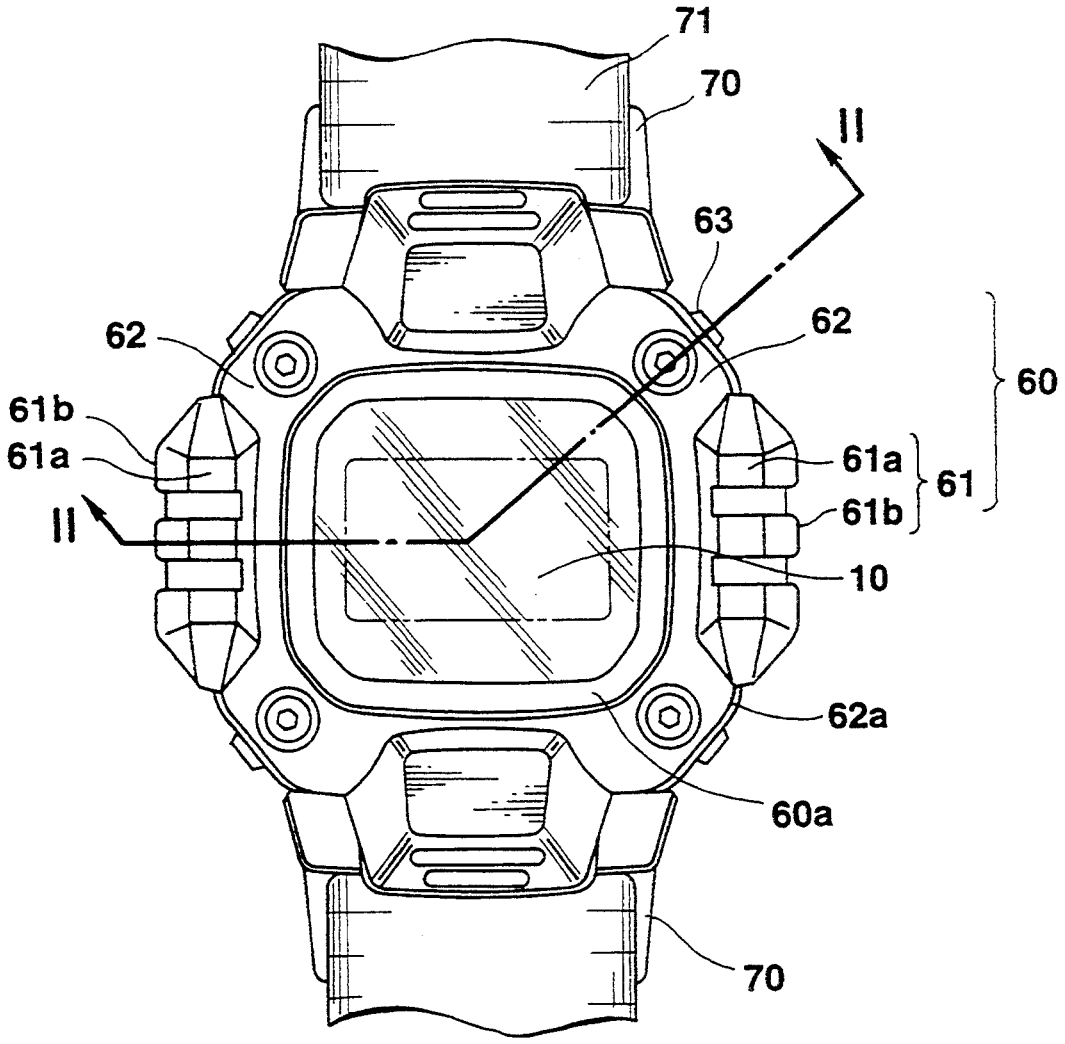
FIG. 10 is a front view showing a wristwatch case according to a third embodiment of the present invention.
Figure 11:
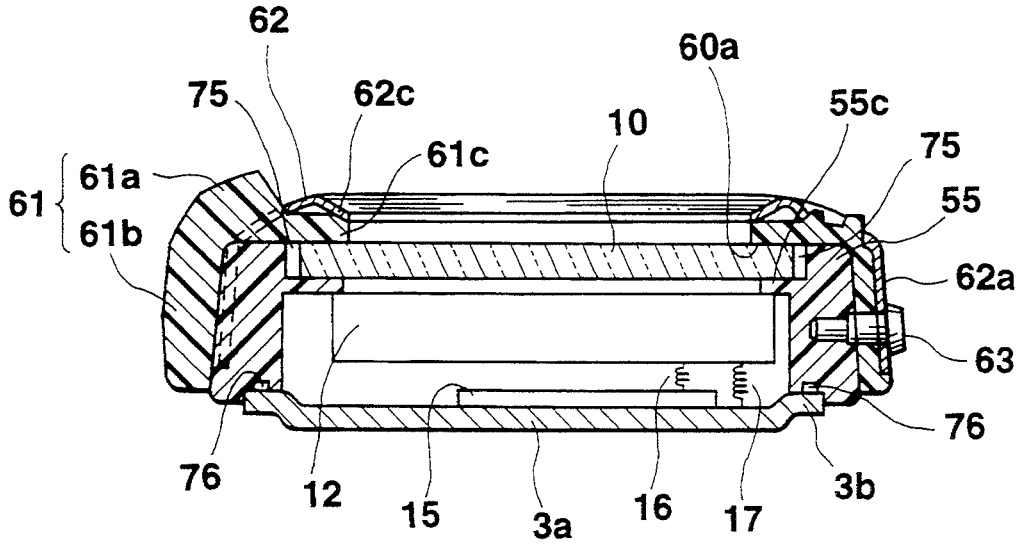
FIG. 11 is a sectional view of a main part of the wristwatch case, taken along line 11—11 in FIG. 10.
Figure 12:
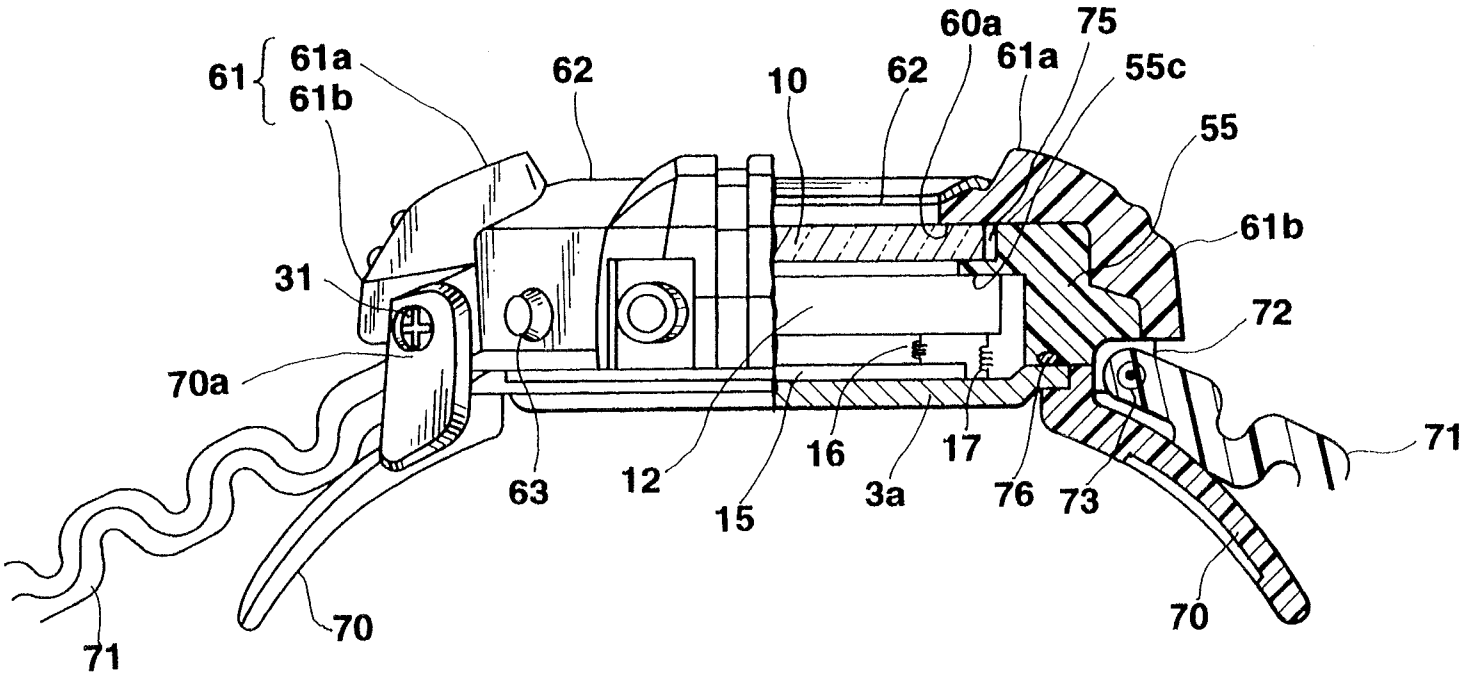
FIG. 12 is a side view showing the wristwatch case in FIG. 10, with a half part thereof being cut.
Figure 13:
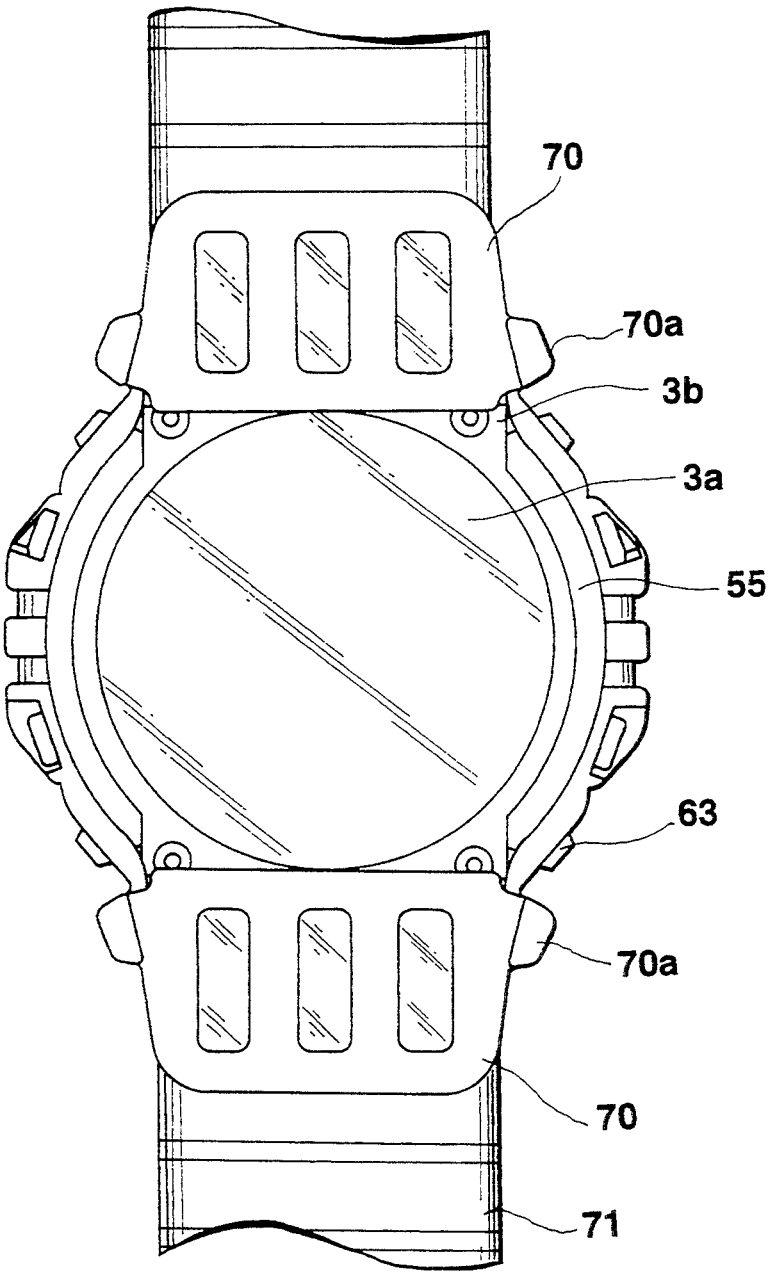
FIG. 13 is a back view showing a back surface the wristwatch case in FIG. 10.

The second cover 62 is shaped like a ring, and is attached to a front surface of the first cover 61. The second cover 62 partly covers the front surface of the first cover 61. In this embodiment, the second cover 62 covers a portion of the front surface of the first cover 61 which are positioned on an outer rim of the cover glass 10 but does not cover portions of the upwardly and sidewardly swelled portions 61*a* and 61*b* of the first cover 61 located at 6- and 12-o'clock positions on the wristwatch case body 55, as shown in FIG. 10. This second cover 62 is made of metal such as aluminum or stainless steel, and the second cover 62 is attached to the wristwatch case body 55 by inserting the stepped pins 63 into a wrap portion 62*a* of the second cover 62, the wrap portion 62*a* wrapping a circumferential surface of the first cover 61, and by screwing the stepped pins 63 into the case body 55 as shown in FIG. 11. By partly covering the first cover 61 with the metal-made second cover 62 as described above, a tough, and cold and hard appearance of metal of the second cover 62 are combined with a warm and soft appearance of synthetic resin of the first cover 61. An appearance of the wristwatch can be more tasteful and more high grade, and the wristwatch can has not only the shock-resistant structure but also the characteristic appearance of metal.

Although the cover member 60 is constructed by the first and second covers 61 and 62 in this embodiment, the number of covers as described above is not limited to two but it may be more. In addition, the cover member 60 may be used in the aforementioned first and second embodiments. The piezoelectric element 15 is bonded to the inner surface of the cover main portion 3*a* of the back cover 3 to vibrate the cover main portion 3.

The wrist bands 71 are attached to the wristwatch case body 55 by inserting spring rods 5 into band attaching portions 72 which are formed at 6- and 12-o'clock positions of the case body 55. The spring rods 5 are freely rotatably inserted into pin holes 73 of the band attaching portions 72 to thereby make the wrist bands 71 freely swingable. The shock absorbing members 70 are arranged at 6- and 12-o'clock positions near to the outer rim portion on the back surface of the wristwatch case body 55, and the shock absorbing members 70 extend outward and are curved backward. Rising portions 70*a* which rise from both side ends of each of the shock absorbing members 70 to the circumferential surface of the case body 55 are freely swingably attached to the circumferential surface of the case body 55 by screws 31. These rising portions 70*a* are formed integrally with the shock absorbing members 70. Furthermore, the shock absorbing members 70 are made of soft synthetic resin such as foaming urethane, and each of them is shaped like a lip covering end portions of a back surface of the corresponding wrist band 71 at that end of which the wrist band 71 is attached to the wristwatch case body 55. The shock absorbing members 70 reduce or absorb shock applied to the back surface of the wristwatch case body 55 and increase the shock resistance of the wristwatch.

In the case of the third embodiment, it is not necessary that the wrist bands 71 have shock resistant structures because the shock absorbing members 70 can reduce or absorb any shock applied to the back surface of the wristwatch case body 55. Therefore, the wrist bands 71 can be freely swingably attached to the case body 55. This makes the fitness of the wrist bands 71 to the wrist improve. Further, other materials excepting soft synthetic resins, such as nylon, metal, etc. can be used for the wrist bands 71. This makes material-selection and design of the wrist bands 71 become more wide. When a user wears the wristwatch of this embodiment on his or her wrist and the wrist bands 71 swing, the shock absorbing members 70 swing around the rising portions 70*a* which are freely swingably attached to the case body 55. Therefore, the wrist bands 71 can fit more intimately on the wrist so that the fitness of the wristwatch to the wrist is further improved. Further, since the shock absorbing members 70 do not cover the cover main portion 3*a* of the back cover 3, the cover main portion 3*a* of the back cover 3 can be more easily vibrated by the piezoelectric element 15 to generate a greater alarm sound.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A wristwatch case comprising:

a wristwatch case body having wrist band attaching portions;

a back cover attached to a back surface of the wristwatch case body, the back cover having a back surface and an outer rim;

flange portions formed at 6- and 12-o'clock positions on the outer rim of the back cover; and a shock absorbing member attached to a back surface portion of the back cover, the shock absorbing member being attached to the flange portions of the cover.

2. A wristwatch case according to claim 1, wherein the shock absorbing member has substantially the same shape as the outer rim of the back cover.

3. A wristwatch case according to claim 2, wherein:

a piezoelectric element is attached to an inner surface of the back cover to vibrate the back cover; and the shock absorbing member has an opening portion in a center portion thereof.

4. A wristwatch case according to claim 1, further comprising fixing screws for attaching the back cover to the wristwatch case body through the shock absorbing member.

5. A wristwatch case according to claim 1, wherein the shock absorbing member comprises first and second separate members which are respectively attached at 6- and 12-o'clock positions near to an outer rim on the back surface of the back cover, and the first and second members extend outward and curve backward away from the back cover.

6. A wristwatch case according to claim 1, wherein the shock absorbing member includes:

a base portion shaped substantially the same as the outer rim of the back cover; and shock absorbing portions which extend from 6- and 12-o'clock positions of the base portion under the wrist band attaching portions of the wristwatch case body, and wherein the shock absorbing portions curve backward away from the back cover.

7. A wristwatch case according to claim 1, wherein the shock absorbing member is made of synthetic resin.

8. A wristwatch case according to claim 1, further comprising a cover member covering a part of a front surface and a circumferential surface of the wristwatch case body.

9. A wristwatch case according to claim 1 wherein the outer rim of the back cover and the shock absorbing member are both ring shaped, and the shock absorbing member is arranged over an outer surface of the ring shaped outer rim of the back cover.

10. A wristwatch case according to claim 3, wherein said opening portion of the shock absorbing member is over the piezoelectric element.

11. A wristwatch case according to claim 3, wherein the piezoelectric element is bonded to the inner surface of the back cover.

12. A wristwatch case according to claim 6, wherein the base portion and the shock absorbing portions are integrally formed as a single member.

13. A wristwatch case comprising:

wristwatch case body having wrist band attaching portions;

shock absorbing members attached at 6- and 12-o'clock positions of the wristwatch case body and near to an outer rim on a back surface of the wristwatch case body, and the shock absorbing members extending outward and curving backward away from the back surface of the wristwatch case body; and a cover member covering at least a part of a front surface and a circumferential surface of the wristwatch case body.

14. A wristwatch case according to claim 10, further comprising a back cover attached to the back surface of the wristwatch case body, and wherein a piezoelectric element is attached to an inner surface of the back cover to vibrate the back cover.

15. A wristwatch case according to claim 13, wherein the shock absorbing members are made of synthetic resin.

16. A wristwatch case according to claim 14, wherein the piezoelectric element is bonded to the inner surface of the back cover.

17. A wristwatch case comprising:

a wristwatch case body having wrist band attaching portions at 6- and 12-o'clock positions of the wristwatch case body; and shock absorbing members respectively arranged at the 6- and 12-o'clock positions near to an outer rim on a back surface of the wristwatch case body, and wherein the shock absorbing members are freely swingably attached to the wristwatch case body.

18. A wristwatch case according to claim 17, wherein each of the shock absorbing members has opposite side ends and rising portions respectively extending from the opposite side ends to a circumferential surface of the wristwatch case body, and wherein said rising portions are freely swingably attached to the circumferential surface of the wristwatch case body.

19. A wristwatch case according to claim 18, further comprising fixing screws for freely swingably attaching the rising portions of the shock absorbing members to the circumferential surface of the wristwatch case body.

20. A wristwatch case according to claim 17, wherein the shock absorbing members are attached at the 6- and 12-o'clock positions near to the outer rim on the back surface of the wristwatch case body, and wherein the shock absorbing members extend outward and curve backward away from the back surface of the wristwatch case body.

21. A wristwatch case according to claim 17, wherein the shock absorbing members are made of synthetic resin.

22. A wristwatch case according to claim 17, further comprising cover members covering at least a part of a front surface and a circumferential surface of the wristwatch case body.

23. A wristwatch case according to claim 17, further comprising a back cover attached to the back surface of the wristwatch case body, and wherein a piezoelectric element is attached to an inner surface of the back cover to vibrate the back cover.

24. A wristwatch case according to claim 23, wherein the piezoelectric element is bonded to the inner surface of the back cover.

25. A wristwatch case according to claim 18, wherein each of the shock absorbing members is integrally formed with the rising portions at the opposite sides thereof as a single member.

26. A wristwatch case according to claim 25, wherein the shock absorbing members are integrally formed as one piece with a base member.

27. A wristwatch case according to claim 26, wherein the base member is ring shaped and has substantially the same shape as the outer rim on the back surface of the wristwatch case body.

* * * * *